US005318414A

United States Patent [19]

Lundback

[11] Patent Number: 5,318,414

[45] Date of Patent: Jun. 7, 1994

[54] VALVE ARRANGEMENT AND POSITIVE-DISPLACEMENT PUMP

[75] Inventor: Stig Lundback, Vaxholm, Sweden

[73] Assignee: Humanteknik AB, Sweden

[21] Appl. No.: 960,436

[22] PCT Filed: Jun. 7, 1991

[86] PCT No.: PCT/SE91/00410

§ 371 Date: Dec. 7, 1992

§ 102(e) Date: Dec. 7, 1992

[87] PCT Pub. No.: WO91/19098

PCT Pub. Date: Dec. 12, 1991

[30] Foreign Application Priority Data

Jun. 7, 1990 [SE] Sweden ..... 9002051-2

[51] Int. Cl.[5] ..... F04B 43/02

[52] U.S. Cl. ..... 717/478; 417/474; 251/331

[58] Field of Search ..... 417/474, 475, 478, 479; 251/298, 331; 137/855

[56] References Cited

U.S. PATENT DOCUMENTS

| | | | |
|---|---|---|---|
| 862,867 | 8/1907 | Eggleston | 417/472 |
| 4,642,037 | 2/1987 | Fritchman | 137/855 |
| 4,840,542 | 6/1989 | Abbott | 417/479 |
| 5,209,654 | 5/1993 | Nilsson | 417/478 |

FOREIGN PATENT DOCUMENTS

| | | |
|---|---|---|
| 0374115 | 6/1990 | European Pat. Off. . |
| WO8701769 | 3/1987 | PCT Int'l Appl. . |
| 88044482 | 6/1990 | Sweden . |

*Primary Examiner*—Richard A. Bertsch
*Assistant Examiner*—Peter Korytnyk
*Attorney, Agent, or Firm*—Hill, Steadman & Simpson

[57] ABSTRACT

A positive displacement pump, particularly a liquid metering or batching pump, includes a fluid inlet, a pump chamber of variable volume, an outlet through which fluid leaves the pump chamber, a driven injection member for repetitive displacement of fluid from the pump chamber, and a valve which functions to open and close a flow passage connecting the inlet with the pump chamber. The flow passage is formed by a gap which extends around at least the major part of the circumference of the pump chamber and which can be open to a height which varies from a smallest value at the ends of the gap to a largest value at a location between the circumferential ends of the gap. The valve includes a valve member which extends along the flow passage and which is pivotally mounted on a pivot adjacent the circumferential ends of the passage.

8 Claims, 1 Drawing Sheet

VALVE ARRANGEMENT AND POSITIVE-DISPLACEMENT PUMP

BACKGROUND OF THE INVENTION

The present invention relates to a piston-type positive-displacement pump and also to a valve arrangement which can be used, for instance, as an inlet valve in such pumps.

European Patent Application No. 89850427.9 discloses piston-type positive-displacement pumps, some embodiments of which are provided with flap valves and other embodiments of which are provided with mechanically operated pinch valves for blocking and unblocking the flow of fluid between an inlet and a pump chamber and in certain cases also between the pump chamber and an outlet.

An important feature of the pumps disclosed in the aforesaid patent application is that the inlet communicates with the pump chamber through a flow passage in the form of a gap which extends around the full circumference of the pump chamber, or at least over a major part of the circumference.

In those embodiments where the outlet is positioned centrally in the pump chamber, the pump can be readily constructed so that the flow passage will extend completely around the pump chamber, such that the passage will have a maximum circumferential length for a given diameter of the pump chamber and can thus be given a maximum cross-section area. Connected with the flow passage, immediately outside it, is a supply or reservoir chamber, which also extends completely around the pump chamber. Some of these embodiments include flap valves, while others include pinch valves which are operated positively by mechanical actuating means.

In the case of other embodiments, a small part of the pump-chamber circumference is used to accommodate an outlet connection from the pump chamber, with the circumferential ends of the flow passage positioned adjacent the outlet connection on both sides thereof. In these emodiments, the flow of fluid through the flow passage is controlled by means of flap valves.

In all of the emodiments illustrated in the aforesaid patent application, those parts of the pump which come into contact with the pumped fluid are formed by a container which is made of a flexible material (plastic foil or plastic film) and which comprises an inlet connection, a supply or reservoir chamber into which the inlet connection opens, a pump chamber, a flow passage extending between the two chambers, and an outlet connection, which extends from the pump chamber and which may include an equalizing chamber. The container is formed from two superimposed plastic-foil sheets which are heat-sealed together to form the just-mentioned parts.

When a pump of the kind described in the aforesaid patent application is to be used as a metering or volumetric batching pump with which high demands are placed on the exactness of the volume of fluid metered or batched by the pump, as is the case with liquid-packaging machines, for instance, it is preferred to use mechanically and positively controlled pinch valves, since flap valves are not able to close with sufficient precision. The use of positively controlled pinch valves causes no particular problems in those instances where the flow passage extends around the whole of the pump-chamber circumference, since in such cases the container walls may part from one another along a closed curve (circle) to open the flow passage. On the other hand, a problem is created when the flow passage is broken or interrupted for accommodating the outlet connection, since the container walls are heat-sealed together or held together in some other way at the ends of the flow passage.

SUMMARY OF THE INVENTION

The object of the present invention is to provide a solution to the problem just mentioned.

This object is achieved in accordance with the invention by constructing the pump and the valve arrangement as set forth in the claims.

The invention will now be described in more detail with reference to the accompanying schematic drawings.

DETAILED DESCRIPTION OF THE PREFERRED EMBODIMENTS

Figure 1:
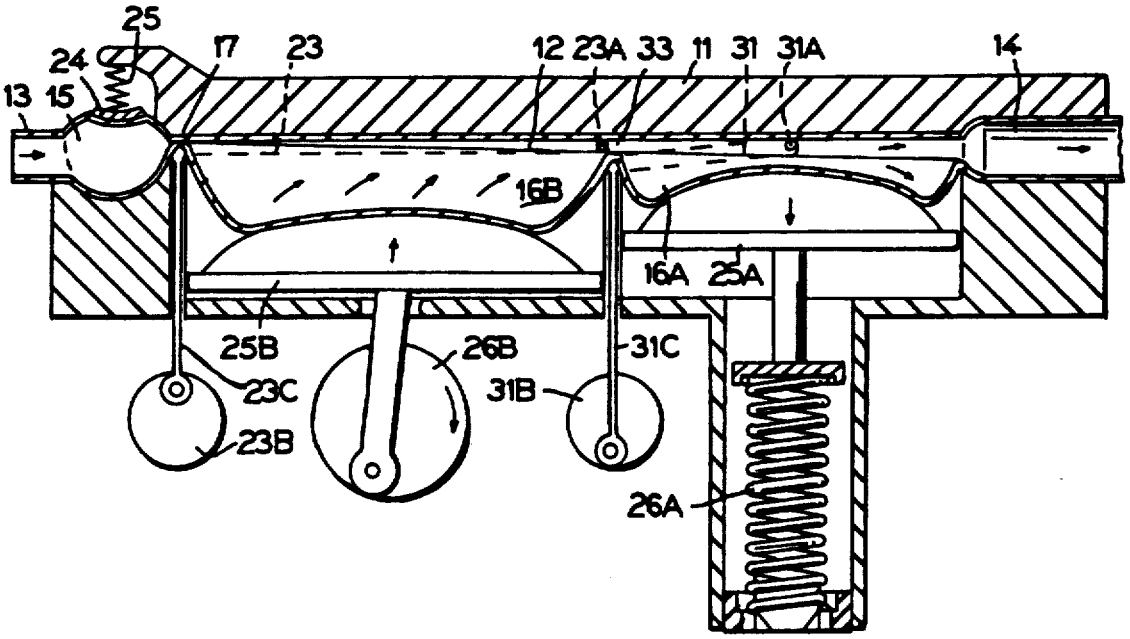
FIG. 1 is a schematic view, in vertical section, of a pump constructed in accordance with the invention and capable of being used as a metering or volumetric hatching pump for repeatedly delivering liquid batches or portions whose volumes are maintained within narrow tolerances.
Figure 2:
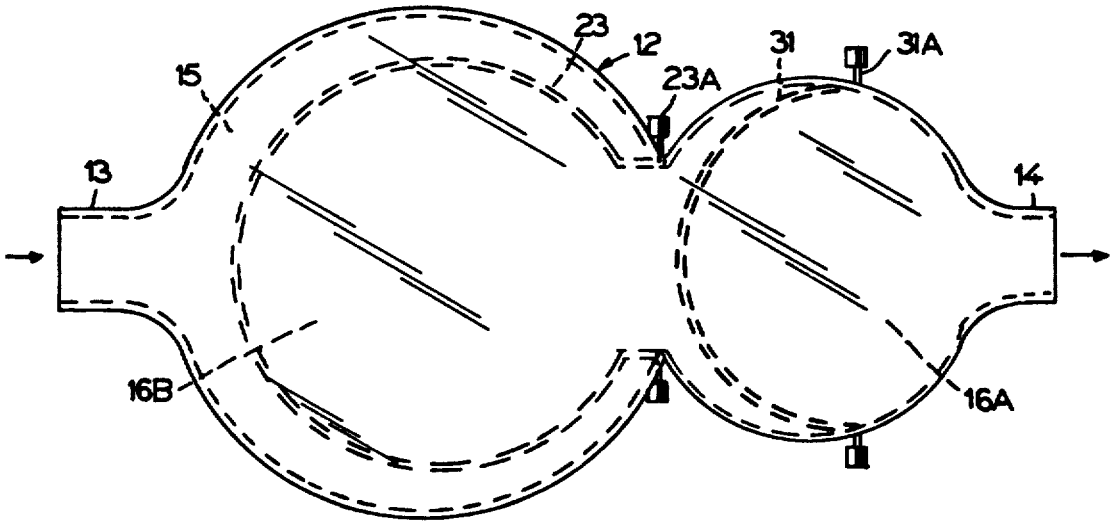
FIG. 2 is a schematic top view of a container element included in the pump and a pinch-valve means coacting with the container element.

The pump illustrated schematically in the drawings is constructed in accordance with the principles explained in the aforementioned European patent application, the descriptive portion and associated drawings of which are incorporated herein by reference. The pump illustrated in the accompanying drawings will only be described here to the extent necessary for an understanding of the present invention in the light of the disclosure of the aforesaid European patent application. For a more comprehensive description of the pumps, reference is made to said patent application, particularly to the description of the embodiments illustrated in FIGS. 6 and 10.

The illustrated pump according to the present invention has two displacement members 25A and 25B which operate in the same manner as similar displacement members described with reference to FIGS. 9A, 9B of the aforesaid European patent application. Thus, the displacement member 25B has a drive mechanism 26B which is intended to positively drive the displacement member upwardly, whereas the displacement member 25A has an adjustable spring mechanism 26A which constantly urges the displacement member upwardly.

The two displacement members 25A and 25B and the associated compartments or chamber sections 16A and 16B of the container element 12, produced from plastic film, with its inlet connection 13, supply or reservoir chamber 15 and outlet connection 14, lie side-by-side beneath a folding lid or cover member which forms an upward support for the chamber sections of the container element.

Extending between the upper wall and the lower wall of the container element 12, at the junction between the supply or reservoir chamber 15 and the pump-chamber section 16B, is an inlet flow passage 17 which is in the form of a circumferentially extending gap whose circumferential length is about 300°. The gap is opened by moving walls of the container element apart over the circumferential length of the gap. The inlet flow passage, or gap 17 is opened and closed by means of a valve member 23 in the form of a bar which is curved so as to correspond to the curvature of the gap and which thus extends over a center angle of about 300°. The bar lies centrally beneath that part of the lower wall of the container element which forms the bottom of the gap.

The valve member 23 is pivotally mounted on a horizontal pivot 23A which extends transversely across the container element, in the proximity of, or through, the positions where the circumferential ends of the gap are located. Mounted on the other side of the valve member 23, thus in the proximity of the inlet connection 13, is a crank drive 23B having a crank shaft 23C which functions to swing the valve element 23 up and down, around the pivot 23A, such that the valve element 23 when moving upwards pinches or clamps the container walls against the lid 11, thereby blocking the flow passage 17 between the supply or reservoir chamber 15 and the pump-chamber section 16B (this state is shown in FIG. 1), whereas downward movement of the valve member permits the walls to move away from one another, so as to form a gap whose vertical extent or height is greatest on the side lying nearest the inlet connection 13, and which is zero at the region of the pivot shaft 23A.

Provided at the junction between the container section 16B and the container section 16A is another through-flow passage 33 which also is in the form of a gap formed between the upper and lower walls of the container element 12. This gap extends circumferentially over approximately half the circumference of the container section 16A, and is opened and closed synchronously, but not simultaneously, with the movements of the displacement member 25B and the valve mechanism 23, 23B, 23C by a valve member 31, which is similar to the valve member 23. Thus, the valve member 31 comprises a semi-circular bar which is pivotally mounted at its ends on a horizontal pivot 31A and is actuated by a crank shaft and crank mechanism 31B, 31C in a manner similar to the valve element 23.

FIG. 1 shows the valve member 31 in an open position, and as will be seen from the illustration, the open gap-like flow passage 33 has a height or vertical extent which is greatest at the junction of the container section 16B with the container section 16A and which decreases gradually to zero at the pivot 31A.

The displacement member 25A and the associated spring mechanism 26A have the same function and operate in the same manner as the corresponding displacement member and corresponding spring mechanism of the pump illustrated in FIGS. 10A–10C of the aforesaid European patent application.

Like the supply chamber of the pump just mentioned, the supply or reservoir chamber 15 is designed so that it is able to expand relatively freely, i.e. against little or no opposing forces, under the influence of the pressure of the fluid entering through the inlet connection 13, such that the chamber 15 is also able to accommodate fluid which enters during those phases of the pump operating cycle in which the inlet flow passage 17 between the chamber 15 and the chamber section 16B is closed. A thrust member 24 and an associated weak spring 25 function to apply a given, but relatively weak pretension or bias to the chamber 15. The spring 25 is dimensioned and arranged so that its spring force will increase essentially only when the chamber 15 has expanded to near its maximum volume.

When the pump is running, a certain negative pressure is maintained (by means not shown) in that part of the pump in which the container section 16B is located. This negative pressure constantly tends to pull the bottom wall of the container section 16B downwards, so that the container section 16B expands while applying suction to the inflowing fluid when the displacement member 25B moves downwards. The negative pressure assists in imparting a well-defined shape to the container section 16B during filling of the pump, and this contributes towards imparting high metering or hatching accuracy to the pump. Naturally, this requires the container element to be made of a material which will not stretch to any appreciable extent under the influences of the positive and negative pressures to which it is subjected in operation of the pump.

The pump container element 12 can be readily exchanged and its design renders it suitable for one-time use only. For example, when the pump is used for metering or batching a beverage, the container element can be discarded upon completion of each working period and replaced with a new container element for the next working period. Consequently, it is not normally necessary to clean the pump.

It will be understood that although the container section 16A and associated displacement member 25A and spring mechanism 26A afford valuable advantages in respect of the use and operation of the pump, these pump components are not absolutely necessary. Thus, it lies within the scope of the invention to omit these components and then also to omit the valve element 31 with associated operating means. In this case, the outlet connection 14 will extend directly from the container section 16B.

In a second embodiment of the valve arrangement (not shown) which, like the illustrated and described valve arrangement, can also be used in pumps other than metering or batching pumps, the valve element is not positively actuated, as in the case of the illustrated embodiment. Thus, in certain embodiments, the valve element can be pivoted in its valve closing and/or valve opening direction under the influence of forces which the fluid controlled by the valve arrangement exerts on the valve element. The valve element may then also be pre-stressed or biased in one direction, e.g. by a spring force.

It will be understood that the arrangement of a duplicated valve-element also lies within the scope of the invention, i.e. for two valve elements to be mounted opposite one another on opposite, sides of the flow passage and to arrange the valve elements so that they move towards and away from each other when closing and opening the passage respectively.

The invention claimed is:

1. In a positive-displacement pump having a fluid inlet, a pump chamber of variable volume, an outlet for discharging fluid from the pump chamber, a driven displacement member for repetitive displacement of the fluid in the pump chamber, and a valve for opening and closing a flow passage which connects the inlet with the pump chamber, the improvement comprising the flow passage being formed by a gap which extends around a substantial part of the circumference of the pump chamber and the valve including a valve member which extends along the gap and which is pivotally mounted on an pivot located at the ends of the gap, thus allowing the flow passage to be opened to a vertical extent which varies from a minimum value at the region of the pivot to a greatest value at a location between the ends of the gap.

2. The improvement according to claim 1, wherein the valve element is actuatable by means of a positively acting operating mechanism.

3. The improvement according to claim 1 or 2, wherein the pump chamber, the inlet, the outlet and the flow passage are formed by a container element which is comprised of superimposed and interconnected film sheets which can be separated at the flow passage in order to open the flow passage and pressed together by means of the valve member in order to close the flow passage.

4. The improvement according to claim 3, further comprising a means for subjecting the container element to the influence of a negative pressure during at least a part of the operating cycle of the pump.

5. A valve arrangement for controlling the flow of fluid through a fluid-flow passage extending between wall parts which are relatively movable towards and away from one another to close and open the fluid-flow passage respectively, at least one wall composed of flexible material, comprising a fluid-flow passage extending along an arcuate line; and a corresponding curve valve member arranged along the fluid-flow passage pivoted about a pivot axis that extends close to the ends of the fluid-flow passage, such that when pivoted in one direction, the valve member will press the wall parts together while when pivoted in the other direction will allow the wall parts to separate over the length of the fluid-flow passage and thereby open the passage.

6. A valve arrangement according to claim 5, comprising an operating device which acts positively on said valve member to selectively pivot the valve member in said one direction and in said other direction.

7. A valve arrangement according to claim 5, wherein the valve member can be pivoted by the action of forces applied thereto by the fluid controlled by the valve arrangement.

8. A valve arrangement according to claim 6 or 7, comprising a means for biasing the valve member in one of the first or the second direction.

* * * * *